US009153853B2

(12) United States Patent
Lassiter

(10) Patent No.: US 9,153,853 B2
(45) Date of Patent: Oct. 6, 2015

(54) MONOPOLE TOWER REINFORCEMENT CONFIGURATION AND RELATED METHODS

(71) Applicant: Wake Skykeeper, LLC, Raleigh, NC (US)

(72) Inventor: Michael L Lassiter, Holly Springs, NC (US)

(73) Assignee: Wake Skykeeper, LLC, Holly Springs, NC (US)

( * ) Notice: Subject to any disclaimer, the term of this patent is extended or adjusted under 35 U.S.C. 154(b) by 0 days.

(21) Appl. No.: 13/975,638

(22) Filed: Aug. 26, 2013

(65) Prior Publication Data

US 2014/0053500 A1 Feb. 27, 2014

Related U.S. Application Data

(60) Provisional application No. 61/692,847, filed on Aug. 24, 2012.

(51) Int. Cl.

| | |
|---|---|
| ***H01Q 1/12*** | (2006.01) |
| *E04H 12/08* | (2006.01) |
| *E04H 12/22* | (2006.01) |

(52) U.S. Cl.

CPC ..... *H01Q 1/1242* (2013.01); *E04H 12/085* (2013.01); *E04H 12/2292* (2013.01)

(58) Field of Classification Search

CPC ..... H01Q 1/1242; E04H 12/08; E04H 12/085
See application file for complete search history.

(56) References Cited

U.S. PATENT DOCUMENTS

| | | | | |
|---|---|---|---|---|
| 3,201,834 | A * | 8/1965 | Baittinger | 403/312 |
| 3,734,438 | A * | 5/1973 | Kautz | 211/107 |
| 3,738,072 | A * | 6/1973 | Adrian | 52/170 |
| 4,986,687 | A * | 1/1991 | Ivey | 403/2 |
| 5,963,178 | A | 10/1999 | Jones | |
| 6,108,996 | A * | 8/2000 | McGinnis | 52/651.02 |
| 6,222,503 | B1 | 4/2001 | Gietema et al. | |
| 6,453,636 | B1 * | 9/2002 | Ritz | 52/835 |
| 6,561,736 | B1 * | 5/2003 | Doleshal | 405/251 |
| 6,665,990 | B1 * | 12/2003 | Cody et al. | 52/295 |
| 6,694,698 | B2 * | 2/2004 | Ryan | 52/741.1 |
| 6,742,314 | B2 * | 6/2004 | Young | 52/835 |
| 6,901,717 | B2 * | 6/2005 | Brunozzi et al. | 52/834 |
| 6,915,618 | B2 | 7/2005 | Payne | |
| 7,116,282 | B2 * | 10/2006 | Trankina | 52/845 |
| 7,591,119 | B2 * | 9/2009 | Ritz | 52/835 |
| 7,849,659 | B2 * | 12/2010 | Kopshever, Sr. | 52/745.17 |
| 7,905,069 | B1 * | 3/2011 | Lockwood | 52/514 |

(Continued)

OTHER PUBLICATIONS

Hawkins, David, Discussion of Current Issues Related to Steel Telecommunications Monopole Structures, 2010 Structures Congress, pp. 2417-2438, ASCE.

(Continued)

*Primary Examiner* — Rodney Mintz
(74) *Attorney, Agent, or Firm* — James G. Passé; Passé Intellectual Property, LLC

(57) ABSTRACT

Antenna tower reinforcement configurations use bolted gusset plate and splice plate configurations that allow for increased clearance access using short threaded bolts and threaded gusset plate apertures for increased clearance access and/or ease of installation. The gusset plates are welded to the reinforcement plates rather than bolted. Splice plates are bolted to the gusset plates using splice bolts.

12 Claims, 9 Drawing Sheets

(56) References Cited

U.S. PATENT DOCUMENTS

| | | | | |
|---|---|---|---|---|
| 8,156,712 | B2 * | 4/2012 | Kopshever, Sr. | 52/849 |
| 8,191,332 | B1 * | 6/2012 | Semaan et al. | 52/745.17 |
| 2002/0056250 | A1 * | 5/2002 | Cash | 52/726.4 |
| 2002/0170261 | A1 * | 11/2002 | Brunozzi et al. | 52/721.4 |
| 2003/0010426 | A1 | 1/2003 | Lockwood | |
| 2003/0205021 | A1 * | 11/2003 | Ryan | 52/736.1 |
| 2004/0020158 | A1 * | 2/2004 | Kopshever, Sr. | 52/723.2 |
| 2004/0134161 | A1 * | 7/2004 | Lockwood et al. | 52/736.1 |
| 2004/0148903 | A1 * | 8/2004 | Cash | 52/720.1 |
| 2005/0078049 | A1 * | 4/2005 | Trankina | 343/890 |
| 2005/0183364 | A1 * | 8/2005 | Cash | 52/296 |
| 2006/0196878 | A1 * | 9/2006 | Cook | 220/639 |
| 2006/0272244 | A1 * | 12/2006 | Jensen | 52/223.5 |
| 2007/0256388 | A1 * | 11/2007 | Ianello et al. | 52/651.07 |
| 2009/0300996 | A1 * | 12/2009 | Jones | 52/40 |
| 2011/0138584 | A1 * | 6/2011 | Wild | 24/457 |
| 2011/0138729 | A1 * | 6/2011 | Shiraishi | 52/651.01 |
| 2011/0156984 | A1 * | 6/2011 | Caldwell et al. | 343/890 |
| 2012/0049529 | A1 * | 3/2012 | Murata | 290/55 |
| 2012/0248281 | A1 * | 10/2012 | Bennett | 248/524 |
| 2013/0269290 | A1 * | 10/2013 | Franceschino | 52/854 |
| 2015/0075101 | A1 * | 3/2015 | Semaan | 52/514 |

OTHER PUBLICATIONS

Reese, Brian, Upgrade Monopole Steel Towers with Steel Channel, AGL, Sep. 2009, pp. 37-43, www.agl-mag.com.

* cited by examiner

MONOPOLE TOWER REINFORCEMENT CONFIGURATION AND RELATED METHODS

RELATED APPLICATIONS

This application claims the benefit of and priority to U.S. Provisional Application Ser. No. 61/692,847 filed Aug. 24, 2012, the contents of which are hereby incorporated by reference as if recited in full herein.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

This invention relates to towers that house antennas for cellular, PCS, GPS or other wireless communications or signals. In particular, it relates to devices and methods for reinforcing towers that house such antennas.

2. Background

There are several types of tower structures (sometimes also called "poles") that are used to hold land-based antennas for cellular/PCS communication. Where zoning requirements, restrictive covenants or other provisions or desires require aesthetically acceptable configurations, concealed (monopole) antenna towers are often used, These antennas are integrated within common pole-like objects such as, for example, flag poles, mono-palms and other type tree poles, street-lights, stop-lights and other utility poles (e.g., any type of monopole structure). The concealed antenna towers are configured so that the antennas are not externally visually apparent. The concealed antenna towers have a tubular structure with an internal, longitudinally-extending cavity that holds cables/transmission lines. The concealed antenna towers can hold one or several vertically stacked antenna canisters within a shroud or exterior that surrounds and encloses the antenna canisters, The concealed antenna towers are thus known as "poles" and "slick sticks." See, e.g., U.S. Pat. Nos. 6,222,503 and 5,963,178, the contents of which are hereby incorporated by reference as if recited in full herein.

Other tower structures are used where there are no zoning requirements or less restrictive requirements therefore allowing taller structures not requiring concealed configurations and allowing for antennas to be visually seen and external to the pole structure.

Telecommunication structures in the United States are covered under TIA-222 Reference Standards (ANSI-approved standards) for minimum requirements for the design and analysis of towers and monopoles that support communication antennas and equipment. However, not all towers have the same design, capacity or structural reliability. Various shaft upgrades and reinforcing designs have been proposed for the towers so that the towers can add more antennas to existing monopoles to respond to the growing demand. Field bolted, rather than welded, designs have been developed in response to the risks posed by field welded systems, including flat plate systems, folded plate systems, and heavy channel systems. See, e.g., Brian Reese, *Upgrade Monopole Steel Towers with Steel Channel*, AGI, September 2009, pp. 37-43

(www.agl-mag.com). and U.S. Pat. No. 6,915,618 and US Patent Application Publication No. 2003/0010426, the contents of which are incorporated by reference as if recited in full herein.

Despite the number of reinforcement designs used, some reinforcement designs have resulted in tower failures such as fires and collapsed pipe or towers. See, e.g., David Hawkins, Discussion of Current Issues Related to Steel Telecommunications Monopole Structures, 2010 Structures Congress, pp. 2417-2438, ©2010 ASCE.

There remains a need for alternate, reliable tower reinforcement designs.

BRIEF SUMMARY OF THE INVENTION

Embodiments of the invention are directed to tower reinforcements.

Some embodiments are directed to reinforced antenna towers; the reinforced antenna towers include a pole having at least a portion configured as a tubular body with a hollow core, the tubular body having an outer wall with an inner and outer surface. The reinforced towers include a first reinforcement plate bolted to the pole wall with longitudinally spaced apart tower wall bolts. The first reinforcement plate has a perimeter with right and left long sides and upper and lower short sides, a rear primary surface that contacts the outer surface of the pole wall and an outwardly facing front primary surface and a second reinforcement plate bolted to the pole wall with longitudinally spaced apart tower wall bolts. The reinforced tower also include a second reinforcement plate having a perimeter with right and left long sides and upper and lower short sides, a rear primary surface that contacts the outer surface of the pole wall and an outwardly facing front primary surface. The upper short side of the second reinforcement plate resides adjacent the lower short side of the first reinforcement plate to define a closely spaced reinforcement plate junction. The reinforced tower also includes an upper pair of laterally spaced apart right and left side gusset plates and an aligned lower pair of laterally spaced apart lower right and left side gusset plates. The upper pair of gusset plates reside above but proximate the lower pair of gusset plates with respective upper and lower right side and left side gusset plates being vertically aligned and closely spaced apart to define a gusset plate junction. The upper right side gusset plate is welded to the front primary surface of the first reinforcement plate adjacent the right long side; the upper left side gusset plate is welded to the front primary surface of the first reinforcement plate adjacent the left long side. The lower right side gusset plate is welded to the front primary surface of the second reinforcement plate adjacent the right long side; the lower left side gusset plate is welded to the front primary surface of the second reinforcement plate adjacent the left long side. Each respective gusset plate has a perimeter with long sides joined by short sides and opposing primary surfaces with a thickness dimension therebetween and each gusset plate includes a plurality of longitudinally spaced apart apertures extending through the thickness dimension so that centerlines thereof are orthogonal to the front primary surface of the reinforcement plates. At least one of the gusset plates has at least one threaded aperture. The reinforcement also includes a right and left side splice plate, each having a perimeter with long sides separated by short sides and having opposing front and rear primary surfaces with a plurality of longitudinally spaced apart apertures extending therethrough. The right side splice plate apertures align with the right side upper and lower gusset plate apertures; the left side splice plate apertures align with the left side upper and lower gusset plate apertures. The reinforced tower also includes a plurality of splice bolts, each bolt having a bolt head and an opposing end that extends through a respective right or left side splice plate aperture into an aligned aperture of the upper or lower corresponding right or left side gusset plate so that the splice bolts extend orthogonal to an axially extending centerline of the bolts extending out from the tower wall into the first and second reinforcement plates. At least one of the splice bolts threadably engages a respective gusset plate threaded aperture with the bolt end residing substantially flush with the respective gusset plate.

In some embodiments, all of the apertures of the right and/or left side gusset plates are threaded, and wherein the corresponding splice bolts threadably engage the right and/or left side gusset plate threaded apertures and have a length that either (i) terminates inside the respective gusset plates or that (ii) is substantially flush therewith to thereby provide a center clearance space between right and left side gusset plates.

The splice bolts can threadably attach to the threaded gusset plate apertures so that respective bolt heads abut an outer surface of the right and left splice plates while the ends of the bolts are substantially flush with a respective gusset plate and are devoid of a nut on the bolt end.

In some embodiments, at least a majority of the apertures of the upper and lower right and left side gusset plates are threaded. The corresponding splice bolts can threadably engage the right and left side gusset plate threaded apertures and have a length such that respective ends thereof either (i) terminate inside the respective gusset plates or that (ii) are substantially flush therewith to thereby provide a center clearance space between right and left side gusset plates.

In some particular embodiments, the gusset plate junction can be longitudinally offset from the reinforcement plate junction to reside a defined distance above or below the reinforcement plate junction.

The splice bolts can be arranged in a pattern that has substantially regularly spaced apart upper and lower splice bolts (for upper and lower gusset plates) that leave an unbolted splice plate region therebetween, the unbolted region extending between the reinforcement plate junction to the gusset plate junction.

The upper right and left side gusset plates can extend a first defined distance beyond the lower short side of the first reinforcement plate. The lower right and left side gusset plates can reside in a second defined distance below the upper short side of the second reinforcement plate. The first and second defined distances can be a substantially common distance between about 1-10 inches.

The lower right and left side gusset plates can extend a first defined distance beyond the upper short side of the second reinforcement plate. The upper right and left side gusset plates can reside in a second defined distance above the lower short side of the second reinforcement plate. The first and second defined distances can be a substantially common distance between about 1-10 inches.

In some embodiments, the first and second reinforcement plates, the upper and lower pair of gusset plates and the right and left side splice plates can define a splice assembly. The tower can have a plurality of splice assemblies at either, or both, circumferentially or longitudinally spaced apart locations of the tower wall.

In some embodiments, all of either the upper right or left side gusset plate apertures are threaded and all of the lower right or left side gusset plate apertures are threaded. The splice bolts can threadably engage the gusset plate threaded apertures and have a length such that respective ends thereof either (i) terminate inside the respective gusset plates or that (ii) are substantially flush therewith to thereby provide a center clearance space between right and left side gusset plates.

The offset of the gusset plate junction and reinforcement junction for the splice assemblies, where used, can be arranged to vary so that one offset arranges the gusset plate junction above the reinforcement plate junction and another splice assembly arranges the gusset plate junction below the reinforcement plate junction.

Other embodiments are directed to kits (e.g., packages of components) for reinforcing an antenna tower. The kits can include: (a) a first reinforcement plate with opposing front and rear primary surfaces with laterally spaced apart left side and right side gusset plates welded to the front primary surface thereof so that the primary surfaces of the right and left side gusset plates are substantially orthogonal to the first reinforcement plate primary surfaces, the right and left side gusset plates each having a plurality of longitudinally spaced apart threaded apertures extending through the primary surfaces; (b) a second reinforcement plate with opposing front and rear primary surfaces, with laterally spaced apart left side and right side gusset plates welded to the front primary surface thereof so that the primary surfaces of the right and left side gusset plates are substantially orthogonal to the second reinforcement plate primary surfaces, the right and left side gusset plates each having a plurality of longitudinally spaced apart threaded apertures extending through the primary surfaces; (c) a right splice plate with a plurality of longitudinally spaced apart apertures extending through a thickness dimension thereof, the right splice plate configured to bolt to the right side gusset plates; (d) a left splice plate with a plurality of longitudinally spaced apart apertures extending through a thickness dimension thereof, the left splice plate configured to bolt to the left side gusset plates; and (e) a plurality of splice bolts configured to extend through aligned apertures of the right splice plate and one of the right side gusset plates or through the left splice plate and one of the left side gusset plates. The bolts have a bolt head and opposing end with a length such that when attached to a respective right or left splice plate and corresponding gusset plate are substantially flush with the respective gusset plate.

The splice bolts can be configured to threadably attach to the respective gusset plates without a nut or washer.

The right and left side gusset plates can extend a defined distance beyond an upper end of the first or second reinforcement plate to define a recess therebetween.

The right and left side gusset plates can terminate a defined distance above a lower end of the first or second reinforcement plate.

The recess (where used) can be sized and configured to receive the lower end of the first or an upper end of the second reinforcement plate so that a junction of the reinforcement plates is offset from a junction of the gusset plates.

The defined distances can be about a substantially common distance of between about 1-10 inches.

The kit can include a plurality of one-sided tower wall bolts.

Still other embodiments are directed to reinforced antenna towers. The towers include: (a) a pole having at least a portion configured as a tubular body with a hollow core, the tubular body having an outer wall with an inner and outer surface; (b) a first reinforcement plate bolted to the pole wall with longitudinally spaced apart tower wall bolts, the first reinforcement plate having a perimeter with right and left long sides and upper and lower short sides, a rear primary surface that contacts the outer surface of the pole wall and an outwardly facing front primary surface; (c) a second reinforcement plate bolted to the pole wall with longitudinally spaced apart tower wall bolts, the second reinforcement plate upper short side residing adjacent a lower short side of the first reinforcement plate to define a closely spaced reinforcement plate junction, the second reinforcement plate having a perimeter with right and left long sides and upper and lower short sides, a rear primary surface that contacts the outer surface of the pole wall and an outwardly facing front primary surface; (d) an upper pair of laterally spaced apart right and left side gusset plates and an aligned lower pair of laterally spaced apart right and left side gusset plates. Each respective gusset plate has a perimeter with long sides joined by short sides and opposing primary surfaces separated by a thickness dimension and are oriented so that the primary surfaces are orthogonal to the front primary surfaces of the first and second reinforcement plates. The upper pair of gusset plates reside above but proximate the lower pair of gusset plates with respective upper and lower right side and left side gusset plates being vertically aligned and closely spaced apart to define a gusset plate junction. Each gusset plate includes a plurality of longitudinally spaced apart threaded apertures extending through the thickness dimension so that a centerline thereof is orthogonal to the front primary surface of the reinforcement plates. The towers also include: (e) a right side splice plate with a plurality of longitudinally spaced apart apertures extending therethrough, the right side long splice plate apertures aligned with corresponding ones of the right side upper and lower gusset plate apertures; (f) a left side splice plate with a plurality of longitudinally spaced apart apertures extending therethrough, the left side splice plate apertures aligned with corresponding ones of the left side upper and lower gusset apertures; and (g) a plurality of splice bolts, each bolt having a bolt head and an opposing end that extends through a respective right or left side splice plate aperture into an aligned threaded aperture of the corresponding upper or lower left or right side gusset plates so that the bolts extend orthogonal to an axially extending centerline of the bolts extending out from the tower wall into the first and second reinforcement plates with the bolt end residing substantially flush with the right side gusset plate to thereby define an open space between right and left side gusset plates for clearance access to tower wall bolts extending out from the reinforcement plates.

Some aspects of the invention are directed to methods of reinforcing an antenna tower. The methods include: (a) bolting a first reinforcement plate to an external surface of a tower wall using tower wall bolts, the first reinforcement plate having right and left side gusset plates welded to a front primary surface thereof so that the right and left side gusset plates extend outwardly from the first reinforcement plate and the gusset plate primary surfaces are substantially perpendicular to the first reinforcement plate primary surface, the right and left side gusset plates having longitudinally spaced apart threaded apertures extending through a thickness dimension that extends between the primary surfaces of the respective gusset plates; (b) bolting a second reinforcement plate to the external surface of the tower wall using tower wall bolts so that the first and second reinforcement plates reside closely spaced apart, one above the other, wherein the second reinforcement plate has right and left side gusset plates welded thereto, the right and left side gusset plates having longitudinally spaced apart threaded apertures extending through a thickness dimension, and wherein a lower end of the first reinforcement plate and an upper end of the second reinforcement plate define a reinforcement plate junction and the right and left side gusset plates of the first and second reinforcement plates define a gusset plate junction; (c) placing a right splice plate against a primary surface of the right side gusset plates of the first and second reinforcement plates; (d) inserting splice bolts with a bolt head and opposing end through the right splice plate into one of the right side gusset plates into the threaded apertures, wherein the splice bolts extend in an axial direction that is perpendicular to the tower wall bolts and the splice bolt ends are substantially flush with the right side gusset plates; (e) placing a left splice plate against a primary surface of the left side gusset plates of the first and second reinforcement plates; and (f) inserting splice bolts with a bolt head and opposing end through the left splice plate into one of the left side gusset plates into the threaded apertures. The splice bolts extend in an axial direction that is perpendicular to the tower wall bolts and the splice bolt ends are substantially flush with the left side gusset plates.

The method may include, before bolting the second reinforcement plate to the tower wall, aligning the second reinforcement plate with a lower end of the first reinforcement plate so that either (i) the lower end of the first reinforcement plate enters a recess defined by the gusset plates of the second reinforcement plate or (ii) the upper end of the second reinforcement plate enters a recess defined by the gusset plates of the first reinforcement plate.

The right and left gusset plates of one of the first or second reinforcement plates can optionally extend a distance beyond a lower or upper end of the respective reinforcement plate to define a recess therebetween and the other right and left gusset plates terminate so that the respective reinforcement plate defines a tongue that can enter the recess.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

The foregoing and other objects and aspects of the present invention are explained in detail in the specification set forth below.

BRIEF DESCRIPTIONS OF THE DRAWINGS

DESCRIPTION OF EMBODIMENTS OF THE INVENTION

Figure 1:
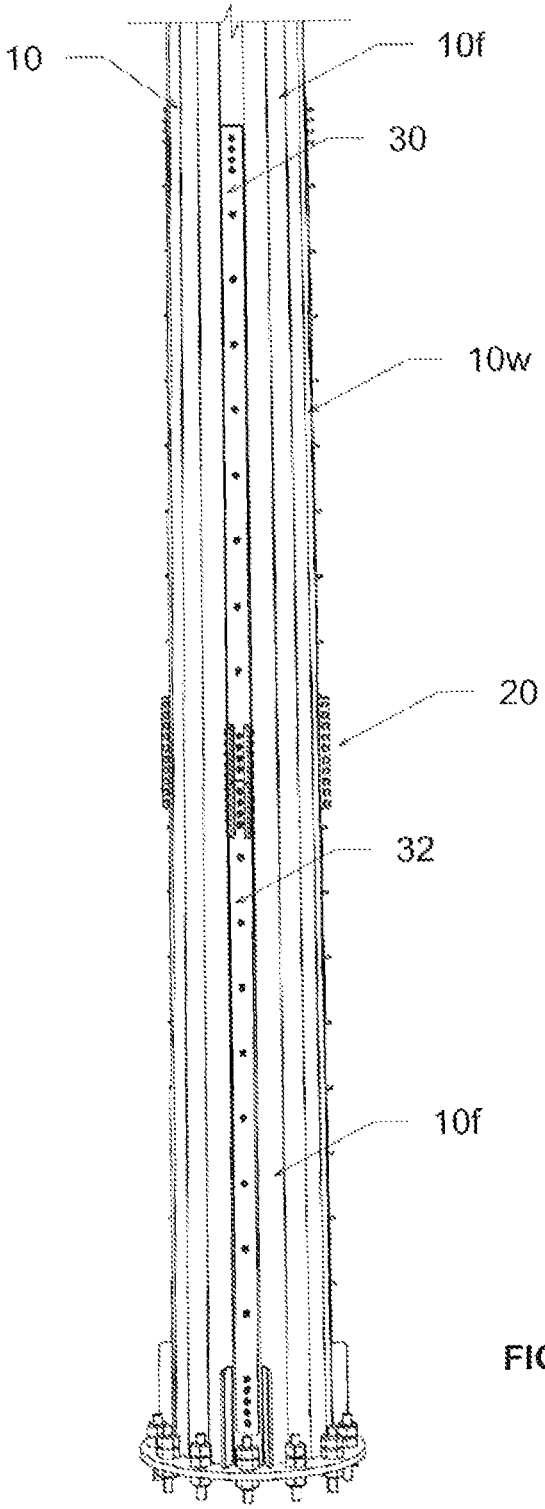
FIG. 1 is a front perspective view of an antenna pole with tower reinforcement according to embodiments of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that although the terms "first" and "second" are used herein to describe various regions, layers and/or sections, these regions, layers and/or sections should not be limited by these terms. These terms are only used to distinguish one region, layer or section from another region, layer or section. Thus, a first region, layer or section discussed below could be termed a second region, layer or section, and similarly, a second without departing from the teachings of the present invention. Like numbers refer to like elements throughout.

The antenna tower will be described as a pole herein. The term "pole" refers to a tubular structure that has at least a portion with a hollow core. The hollow core allows cabling to extend inside the pole from the antenna(s) to an electronic circuitry that resides in a base of the pole and/or in a control station that is typically in a housing structure adjacent the pole. The pole may have a substantially circular, square or other geometric cross-sectional shape. For example, the outer wall of the housing or tower may be circular or may be a multi-faceted polygon, e.g., hexagonal, octagonal and the like. The pole can have a substantially constant diameter or width over its length or it may increase in size such that the bottom portion is larger than a top and/or intermediate portion.

The pole can comprise galvanized steel for structural rigidity and support, particularly at the base portion of the pole. The pole can have at least a portion that is a steel pipe that is between about ¼ inch to about ¾ inch thick, typically about ½ inch. However, other suitable strength materials and thicknesses that can withstand environmental (weather and wind)

conditions may be used, including, for example, composites, rigid polymers, wood, ceramics and concrete or combinations thereof.

The diameter or width of the pole can vary along its length as well as for different uses or types of poles. The pole can have a height that is between about 6 feet to about 220 feet, more typically between about 20-160 feet. The pole can include one or more hand holes along its length and may include one or more above ground exit ports for transmission lines proximate a lower portion of the pole and/or a below ground path for transmission lines. As is well known, the pole can be mounted to a base plate that is supported by a concrete pad and supported by the ground. Some poles have a top flange that will accommodate upward vertical growth. Some poles have multiple entry ports, particularly, "rad" centers (defined below) of co-location tenants (different cellular service providers on the same pole) are known.

The pole can have one or a plurality of stacked sections of antennas corresponding to one or a plurality of "rads", respectively. The term "rad" refers to a centerline of an antenna with respect to the ground; some poles have multiple rads, each at different heights from the ground.

The terms "antenna canister" and "antenna spool" are used interchangeably to refer to structures that mount concealed antennas to poles for cellular, PCS, GPS or other wireless (radio) communications. The concealed antennas are typically monopole antennas as is known to those of skill in the art, but it is contemplated that embodiments of the invention may be used for other towers and/or antenna types.

Figure 2:
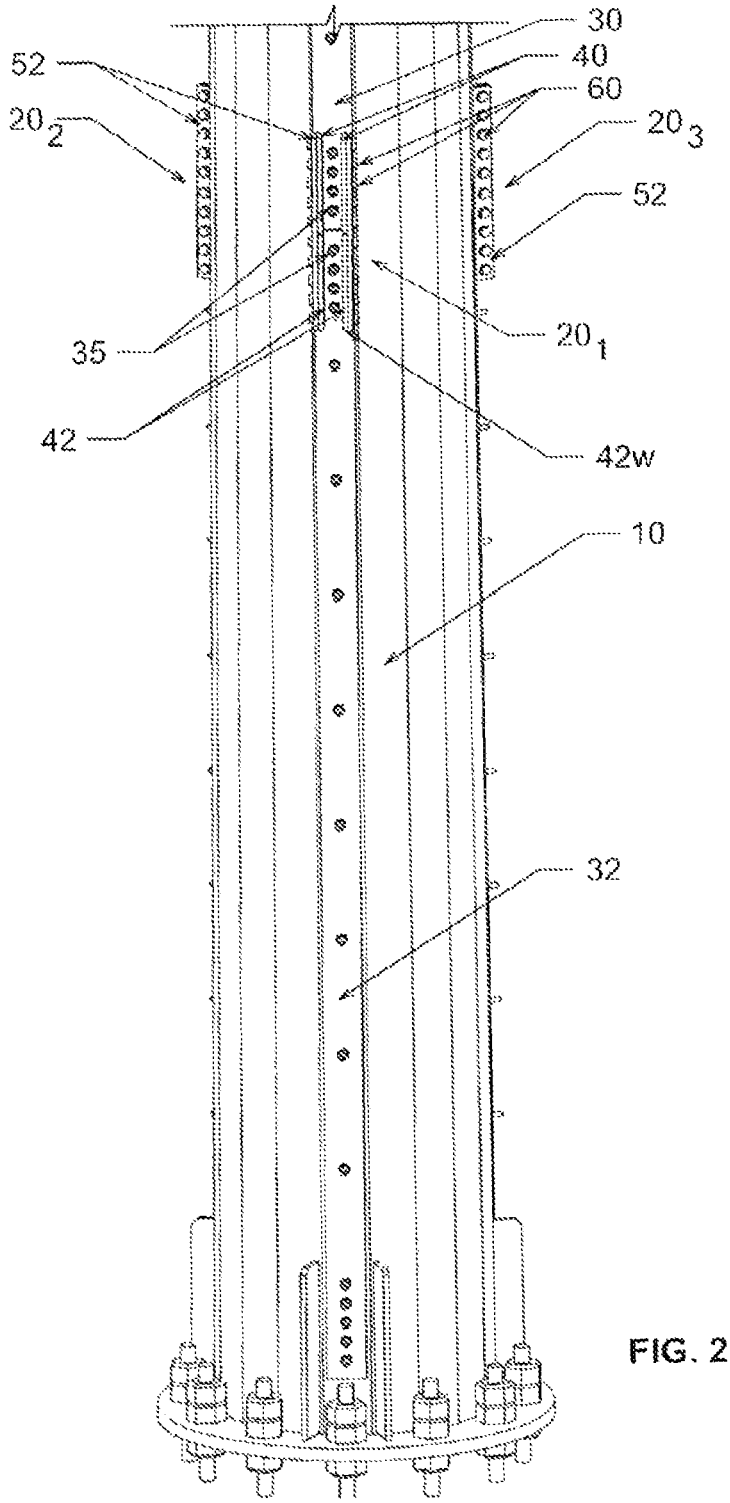
FIG. 2 is an enlarged partial side perspective view of the tower reinforcement shown in FIG. 1 according to embodiments of the present invention.

Referring now to the figures, FIGS. 1 and 2 illustrate a tower or pole 10 with a reinforcement configuration $\mathbf{20}_1$, $\mathbf{20}_2$, $\mathbf{20}_3$ having a splice design that includes an upper reinforcement plate 30 and an adjacent lower reinforcement plate 32 bolted to the pole 10 using termination bolts 35 such as one sided bolts (e.g., AJAX bolts). The two reinforcement plates 30,32 are in vertical alignment, one above the other, forming a closely spaced junction 30*j*, see FIG. 3*a*. The junction 30*j* should be of sufficient size to allow for thermal expansion. The closely spaced junction 30*j* can be such that adjacent plates reside apart between about 0.25 inches to about 2 inches. The reinforcement plates 30, 32 have a perimeter with two long sides and two short sides that frame primary surfaces, one primary surface contacts the tower wall low and the other, the front or forward (outward facing) surface 30*s*, faces outward. The reinforcement plates 30, 32 are typically flat, rigid (metal) bars, but "U" shaped channels may be used in some embodiments.

The plates 30, 32 may flare out relative to the other width of each plate so as to be wider over the splice region 30*w*, 32*w* to allow for a wider splice junction (FIG. 9) which may allow for ease of installation on some tower walls and the like. The width can increase between about 1-3 inches, in some embodiments.

Figure 3A:
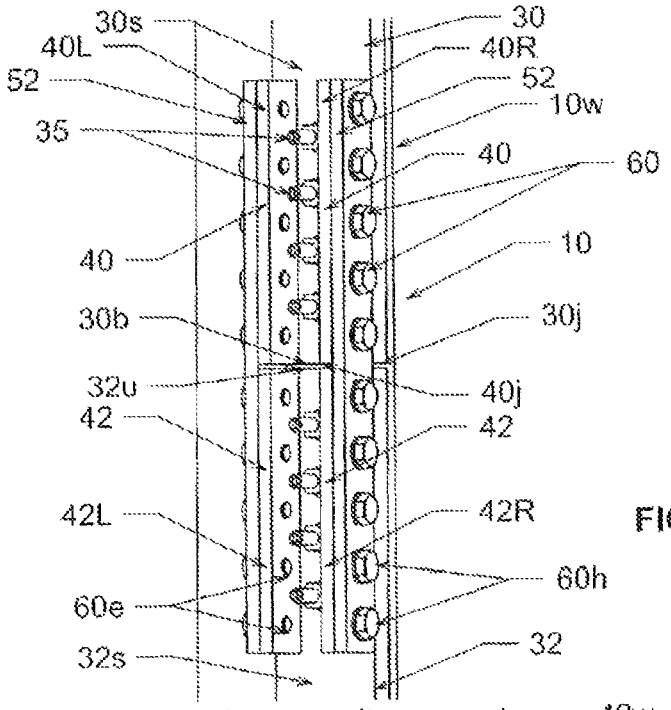
FIG. 3A is an enlarged side perspective view of the splice configuration shown in FIGS. 1 and 2 according to embodiments of the present invention.
Figure 3B:
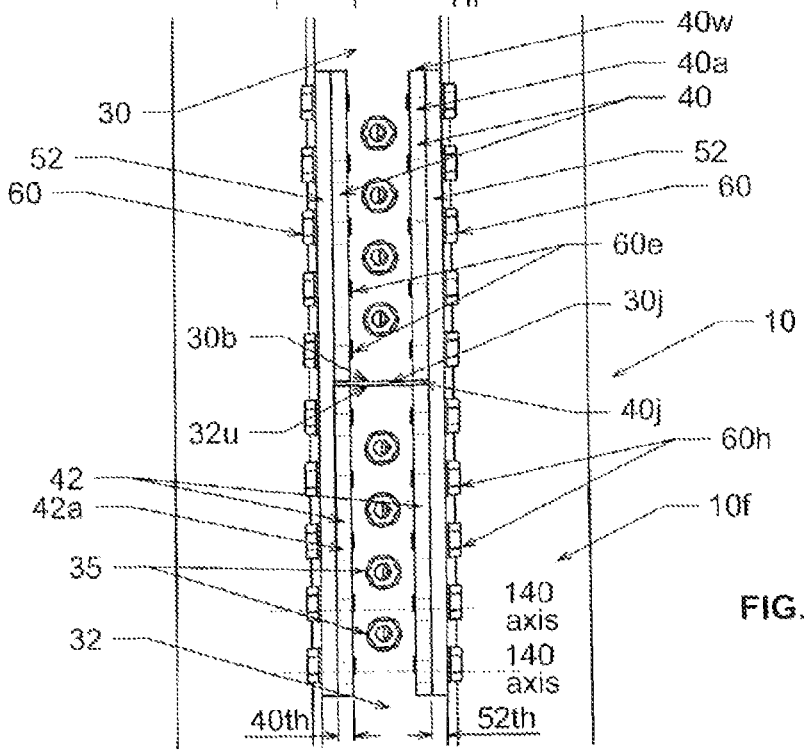
FIG. 3B is a front view of the splice configuration shown in FIG. 3A.
Figure 4:
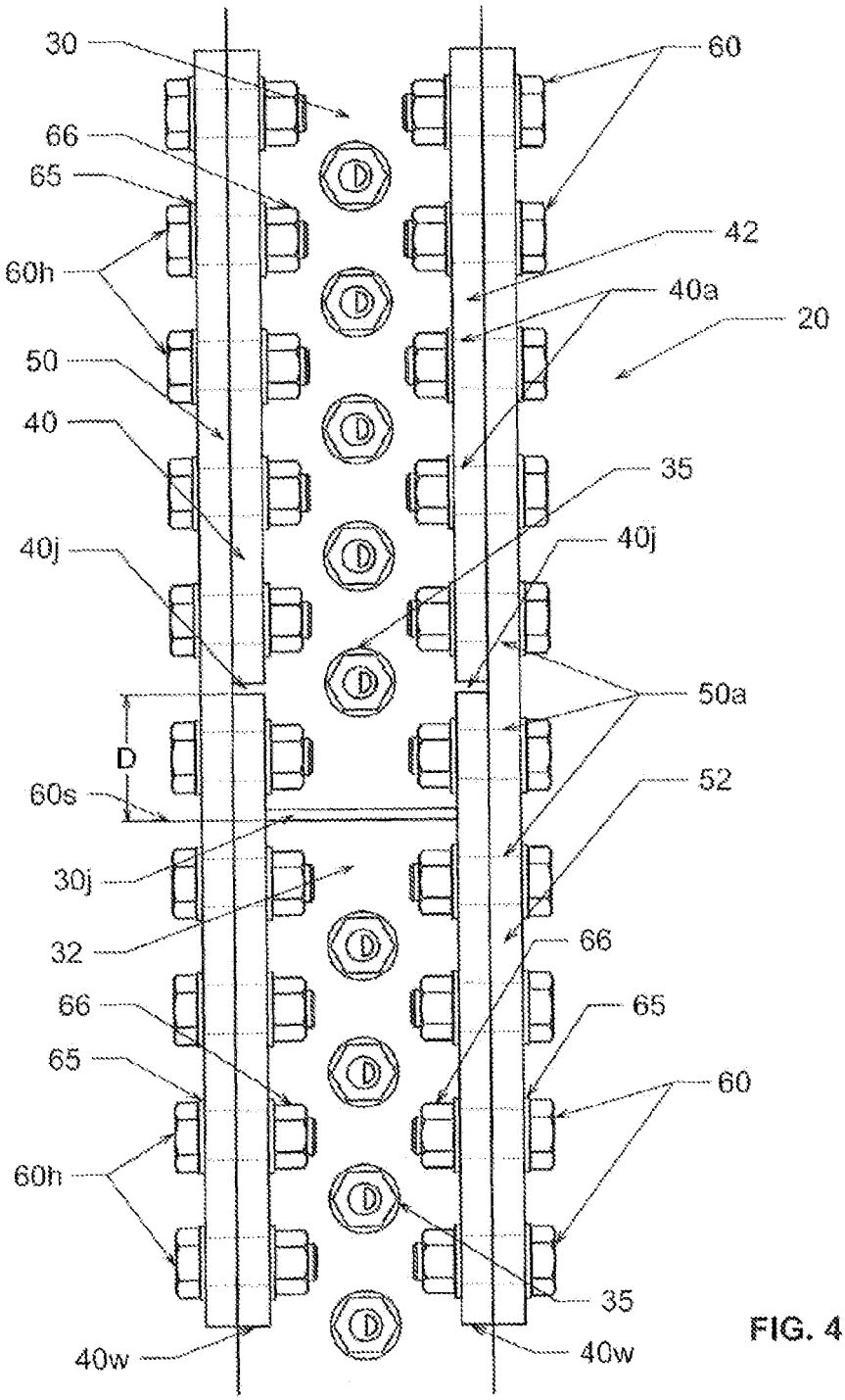
FIG. 4 is a front view of another tower reinforcement according to embodiments of the present invention.

In FIGS. 3A, 4 and 3B each adjacent end portion (short side) of the reinforcement plate 30*b*, 32*u* has a flat gusset plate 40, 42 welded (at 40*w*) to an outer right and left (long side) portion of each front surface 30*s*, 32*s* of the respective flat plates 30, 32. Thus, two laterally spaced apart flat gusset plates 40 (a right and left side plate 40R, 40L, FIG. 3A), are welded to the upper reinforcement bar 30 and two laterally spaced apart flat gusset plates 42 (a right and left side plate 42R, 42L, FIG. 3A) are welded to the lower reinforcement bar 32, with one gusset attached to each laterally spaced apart outer edge portion of a respective reinforcement plate 30,32 and each gusset plate pair 40, 42 being vertically aligned.

Figure 5:
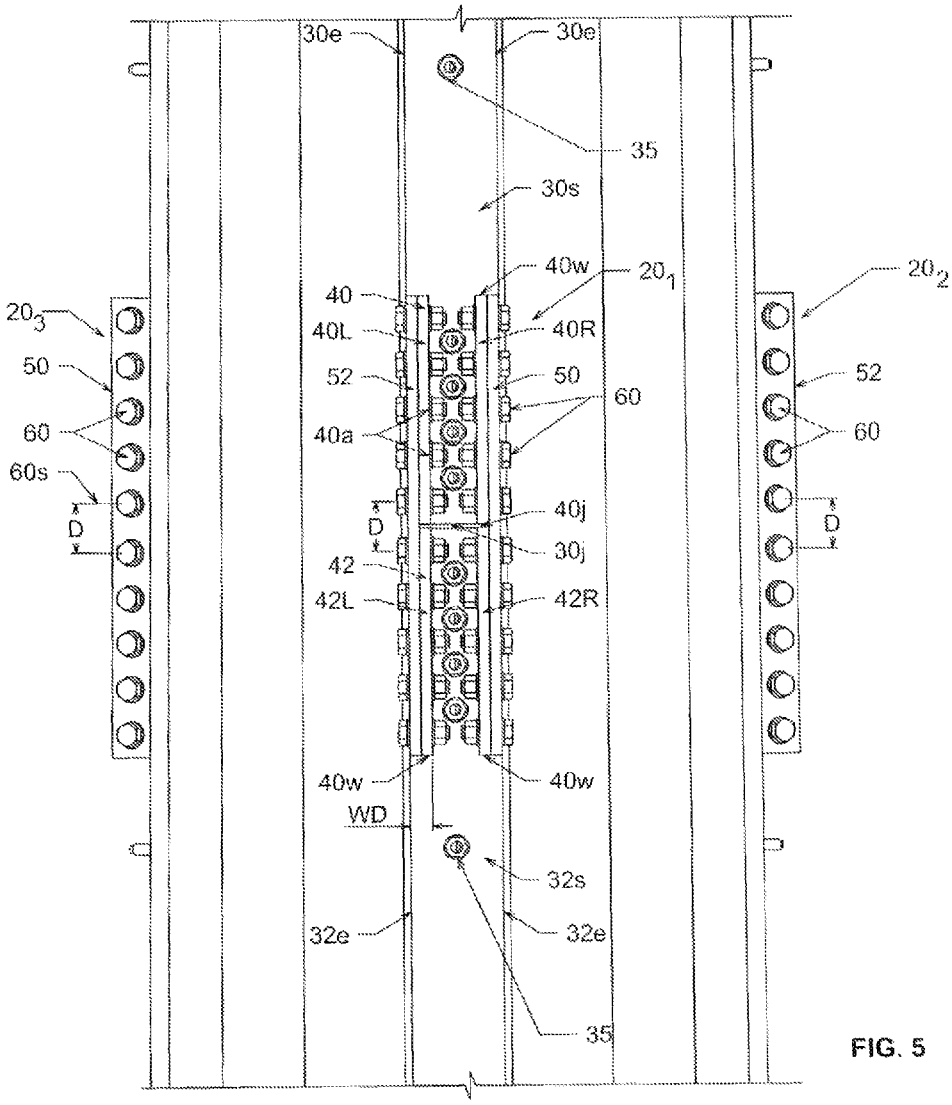
FIG. 5 is a side perspective partial view of a tower with a plurality of circumferentially spaced apart tower reinforcement segments according to embodiments of the present invention.

As shown in FIG. 5, the weld 40*w* can be closely spaced away from the outer edge 30*e*, 32*e* of the respective reinforcement plates a distance "WD" on the front (outwardly facing) surface 30*s*, 32*s*. The distance "WD" can be about the thickness of the splice plate 52, typically a distance that is about 10-30% smaller than the thickness of the splice plate 52 so that part, or all of the splice plate 52 resides over the reinforcement plate 30. In some embodiments, the splice plate 52 has a width and is positioned to extend both inside of and over the outer edge 30*e*, 32*e* thereat.

The gusset plates 40, 42 project outwardly from the front surface 30*s*, 32*s* of the reinforcement plates 30, 32 in a direction that is orthogonal to the front surface 30*s*, 32*s*. Each pair of aligned upper and lower gusset plates 40, 42 are adjacent each other and define a closely spaced junction 40*j*. The upper and lower gusset plates 40, 42 can have the same or different lengths. The upper and lower gusset plates can have substantially the same thickness. The closely spaced junction 40*j* can be such that adjacent plates reside sufficiently apart to allow for thermal expansion, typically between about 0.25 inches to about 2 inches.

The reinforcement 20 in FIG. 1 also includes at least one left hand and at least one right hand side splice plate 52. The splice plates 52 span the splice joint 30*j*. Each splice plate 52 is bolted to one set, the right side or the left side, of the upper and lower gusset plates 40, 42. The splice plates 52 have a length that is longer than a length of one of the gusset plates 40, 42 by between about 1-6 inches. Typically, the splice plates 52 have a length that is about the same or longer than a cumulative length of both of a respective upper and lower gusset plate 40,42. The splice plates 52 can have a thickness that is less than, the same, or greater than the gusset plates 40, 42.

The splice plates 52 are typically outer splice plates 52 that reside outside the respective gusset plate 40,42. However, it is contemplated that inner splice plates may be used in some embodiments. Also, in some embodiments, both inner and outer splice plates 52 may be used to sandwich a respective upper and lower gusset plate pair (not shown). A plurality of splice bolts 60 attach the splice plates 52 to the gusset plates 40, 42. A respective single splice bolt extends through the splice plate 52 and adjacent gusset plate 40 or 42, but not the tower wall 10*w*. Stated differently, each splice plate 52 is bolted directly to one of the pair of respective vertically aligned gusset plates 40 and 42. These bolts 60 axially extend in a plane that is orthogonal to a plane of the bolts 35 that extend from the reinforcement bars 30,32 into the tower wall 10*w*.

FIGS. 3A and 3B illustrate that at least one of gusset plates, typically each of the gusset plates 40, 42, can have at least one, typically a plurality of, threaded apertures 40*a* to threadably engage a respective threaded bolt 60. The threaded apertures 40*a* can axially extend in a plane that is orthogonal to the plane of the axially extending centerline of the bolts 35 (FIGS. 4, 5, 6A) that threadably engage side entry (laterally extending) splice bolts 60. Stated differently, the apertures 40*a* extend through the thickness dimension (40*th*, FIG. 3B) of the gusset plates 40, 42 and the gusset plates 40, 42 are oriented to be perpendicular to the plane of the reinforcement plate primary surfaces and/or the outer surface of the tower wall 10*w*.

In some particular embodiments, as shown in FIGS. 3A and 3B, the side entry splice bolts 60 can be assembled without a nut (on either end) and may also be provided without a washer so that a respective bolt portion is turned into threaded portion of gusset plate 40, 42 and the bolt head 60*h* resides directly against the external primary surface of the respective splice plate 52. The other end 60*e* of the bolts 60 may be flush or slightly recessed into the aperture 40*a* so that they do not extend out of the gusset plate 40. This allows for ease of installation for more clearance for bolts 35. FIGS. 3A and 3B also illustrate that the threaded apertures 40*a* can be arranged so that a respective bolt 35 extends out from the tower wall 10*w* and orthogonally through the plate 30, 32 between adjacent axially extending center lines 140 of the adjacent apertures 40*a*.

In some particular embodiments, one or more of the bolts 60 may extend a small distance, typically less than about 0.25 inches, into the space between the upper gusset plates 40 or lower gusset plates 42 or reside a small distance inside the gusset plate itself typically less than about 0.25 inches. Thus, the term "substantially flush" means that the end of the bolt 60*e* may reside a small distance inside of or extend a small distance outside the bounds of the respective gusset plate 40, 42.

In some embodiments, a particular splice assembly can include combinations of the bolt 60 configurations of FIGS. 3A and 4. For example, one or more of the bolts 60 can have a nutless and washerless bolt assembly configuration for the gusset/splice plate connection such as shown in FIGS. 3A and 3B and one or more of the bolts 60 can have a washer 65 and nut 66 such as shown in FIG. 4, for example. Thus the apertures 40*a* of a particular gusset plate 40, 42 can include both threaded and unthreaded apertures.

In some embodiments, the threaded "short" or flush configuration of the bolts can be provided on a single bolt of the right or left side (40R, 40L, 42R, 42L) in the upper and lower gusset plates and the sides can be different between the upper and lower gussets to provide access or clearance via one side so that all or most of either the upper right 40R or left 40L side gusset plate apertures 40*a* are threaded and all or most of the lower right 42R or left 42L side gusset plate apertures 40*a* are threaded and the corresponding splice bolts threadably engage the gusset plate threaded apertures and have a length such that respective ends thereof either (i) terminate inside the respective gusset plates or that (ii) are substantially flush therewith to thereby provide a center clearance space between right and left side gusset plates.

FIGS. 3A and 3B show that the gusset plate junction 40*j* can substantially align with the reinforcement plate junction 30*j*. However, in some preferred embodiments, the gusset junction 40*j* is longitudinally offset from the reinforcement plate junction 30*j* a distance "D" as shown in FIG. 4. This distance D can be between about 1-10 inches, typically about 2-6 inches, such as about 2 inches, about 3 inches, about 4 inches, about 5 inches or about 6 inches or any spacing therebetween. The offset junctions 30*j*, 40*j* can define a type of "tongue and groove" configuration (allowing for thermal expansion as needed)

Figure 6A:
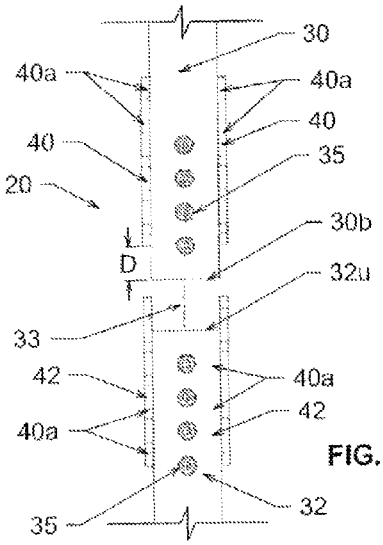
FIGS. 6A and 6B are front partial views of a pair of reinforcement plates with gusset plates arranged to provide a junction offset according to embodiments of the present invention.
Figure 6B:
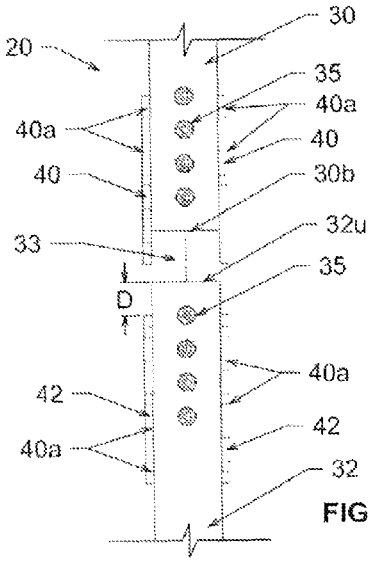

As shown in FIG. 6A, the lower gusset plates 42 of reinforcement plate 32 can extend beyond the bounds of the upper portion of the plate 32*u* defining a recess 33 while the mating component has the reinforcement plate 30 extending downward a distance "D" beyond the lower end of the gussets 40 defining a tongue 35. FIG. 6B illustrates the opposite or mirror configuration.

As shown in FIGS. 4 and 5, the spacing of the splice bolts 60 along the splice plate 50 and/or 52 can be such that there is a longer space 60*s* with a substantially corresponding distance D between adjacent splice bolts 60, extending between the two junctions, 30*j*, 40*j* relative to splice bolts 60 above and below this region. Stated differently, the splice bolts 60 can be arranged in a pattern so that upper and lower splice bolts are substantially regularly spaced apart and an unbolted region 60*s* resides proximate a space between the two junctions 30*j*, 40*j*.

FIG. 4 also illustrates that the neighboring upper and lowermost bolts 60 for the upper and lower gusset plates 40, 42 may include a washer and nut 60 that abuts the splice plate 52. The bolt heads 60*h* of the intermediate bolts may abut or reside directly against the splice plate 52. FIG. 4 illustrates that the lower end of the gusset plates 32 may also include a washer and nut 60.

The gusset plates 40 and 42 can be welded to the respective reinforcement plate 30, 32 prior to installation on a tower wall 10*w*, and can be provided as an integrated subassembly for field installation. The gusset plates 40, 42 can include pre-drilled or formed apertures 40*a*. The splice plates 50 and/or 52 can also include pre-drilled or formed apertures 50*a*; the apertures 40*a*, 50*a* can leave the unbolted space 60*s*.

FIGS. 6A and 6B show the reinforcement plates 30, 32 with gusset plates 40, 42 welded thereto in a manner that provides the offset of junctions 30*j*, 40*j* when attached to a tower wall 10*w*. The offset can be such that junction 40*j* resides above or below junction 30*j*. Where a series of plates 30, 32 and reinforcements are used on a tower wall 10*w* segment, the offset between different pairs of adjacent junctions 30*j*, 40*j* can be configured to be the same amount of offset or different amount of offset. In some embodiments, each gusset plate junction 40*j* may reside above the reinforcement plate junction 30*j*. In other embodiments, each gusset plate junction 40*j* may reside below the reinforcement plate junction 30*j*. In yet other embodiments, one gusset plate junction 40*j* may reside above the reinforcement plate junction 30*j* and a next upper or lower reinforcement splice configuration can be configured so that the gusset plate junction 40*j* is below the respective reinforcement plate junction 30*j*.

Figure 7:
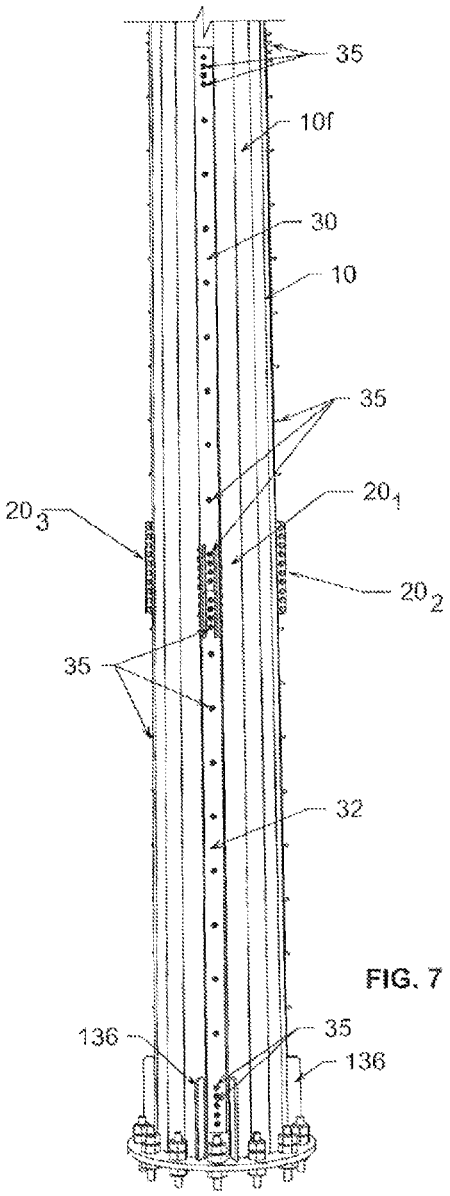
FIG. 7 is a schematic illustration of a tower with reinforcements with circumferentially spaced apart splice assemblies according to embodiments of the present invention.

FIG. 7 shows that the reinforcement assemblies 20 can be provided on a plurality of different assemblies $\mathbf{20}_1$, $\mathbf{20}_2$, $\mathbf{20}_3$ on different vertical (flat) facets 10*f* of the tower wall 10*w*, typically substantially symmetrically spaced apart about the circumference. The offsets of circumferentially spaced apart splice assemblies can be longitudinally offset so that the assemblies $\mathbf{20}_1$, $\mathbf{20}_2$, $\mathbf{20}_3$ have respective junctions 30*j* that are substantially aligned at a longitudinal level or position but with the gusset junction 40*j* configured so that at least one assembly has the gusset junction 40*j* above the corresponding reinforcement plate junction 30*j* while another has the gusset junction 40*j* below the reinforcement plate junction 30*j*.

Figure 8A:
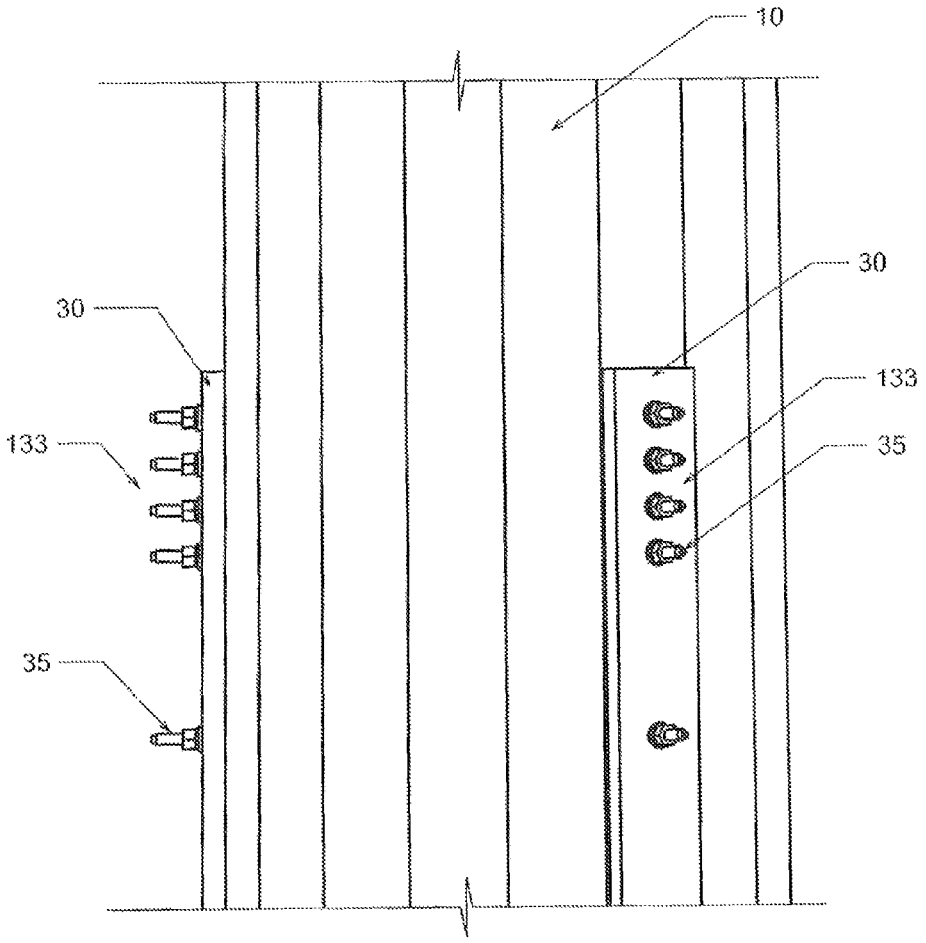
FIG. 8A is an enlarged side perspective view of an upper portion of the reinforced tower shown in FIGS. 1 and 2.
Figure 8B:
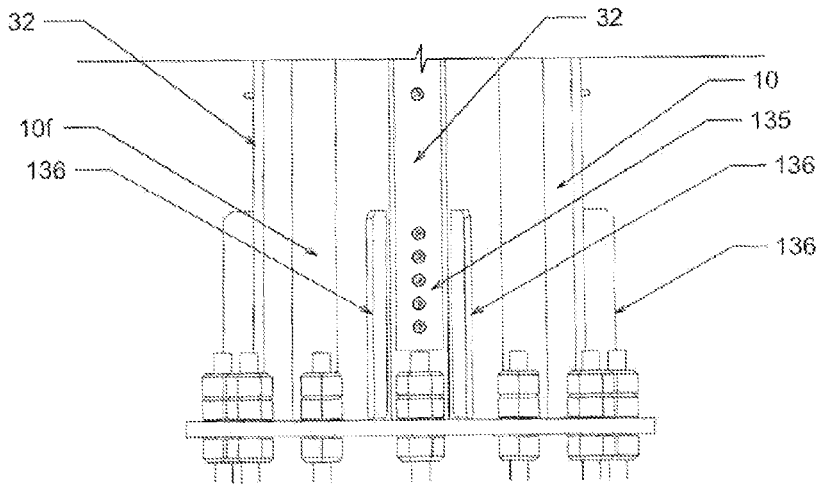
FIG. 8B is a front enlarged view of a bottom portion of the tower shown in FIG. 7 according to some embodiments of the present invention.
Figure 8C:
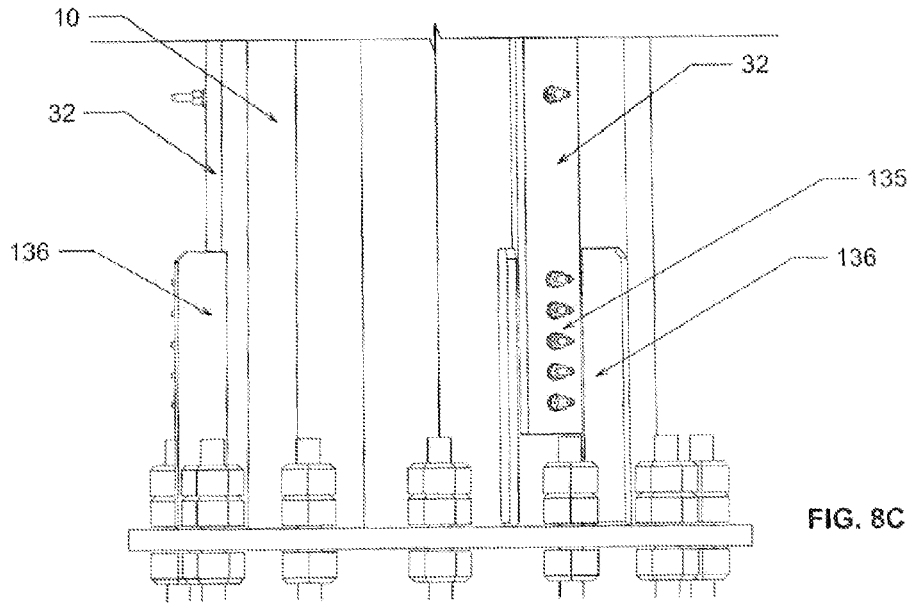
FIG. 8C is a side perspective view of the bottom portion of the tower shown in FIG. 8B.

FIG. 8A illustrates an exemplary attachment configuration 133 for the upper portion of the plate 30. FIGS. 8B and 8C illustrate an exemplary bolt attachment configuration 135 and reinforcement fins 136 for the lower portion of the plate 32.

Figure 9:
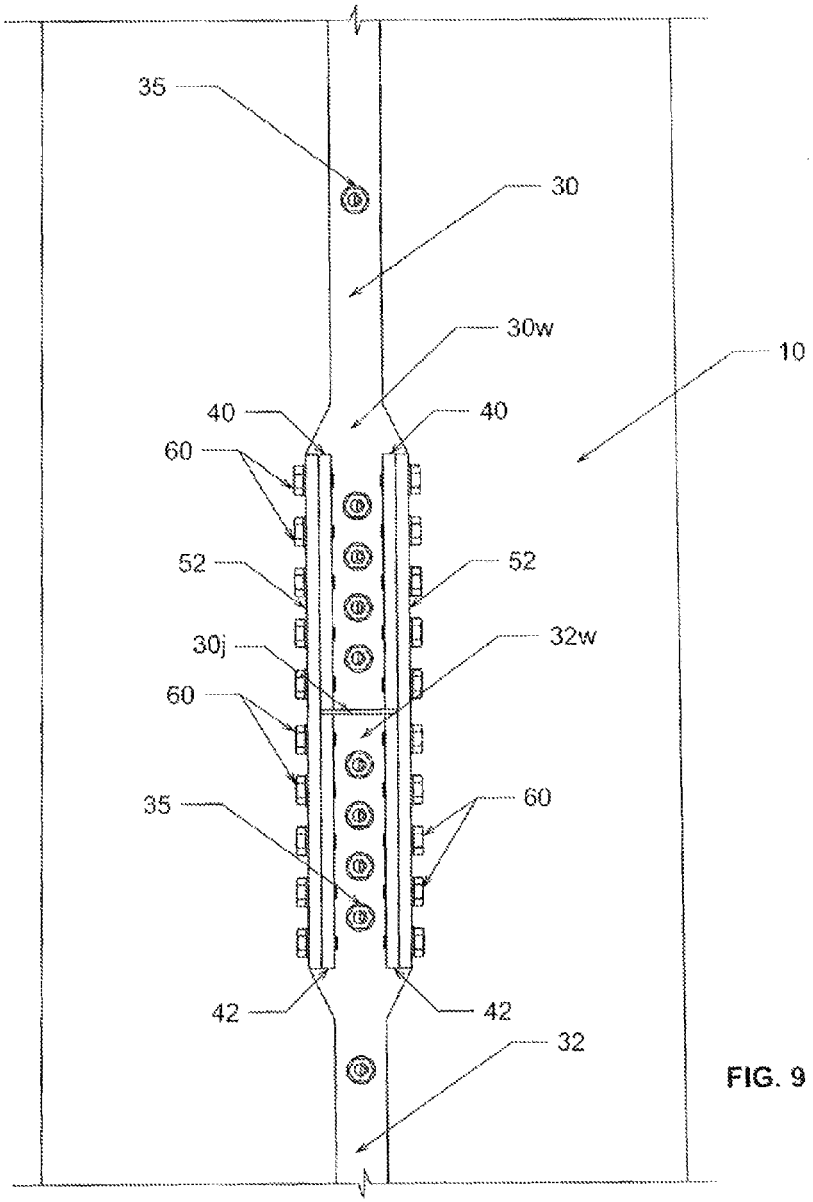
FIG. 9 is a schematic illustration of an another embodiment of a splice assembly according to embodiments of the present invention.

FIG. 9 is a close up view of the intersection 30*j* of upper reinforcement plate 30 with wall face 30*w* and lower reinforcement plate 32 with wall face 32*w*.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus function clauses, if used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A reinforced antenna tower comprising:

a) a pole having at least a portion configured as a tubular body with a hollow core, the tubular body having an outer wall with an inner and outer surface;

b) a first reinforcement plate bolted to the outer wall with longitudinally spaced apart tower wall bolts, the first reinforcement plate having a perimeter with right and left long sides and upper and lower short sides, a rear primary surface that contacts the outer surface of the outer wall and an outwardly facing front primary surface;

c) a second reinforcement plate bolted to the outer wall with longitudinally spaced apart tower wall bolts, the second reinforcement plate having a perimeter with right and left long sides and upper and lower short sides, a rear primary surface that contacts the outer surface of the outer wall and an outwardly facing front primary surface wherein the upper short side of the second reinforcement plate resides adjacent the lower short side of the first reinforcement plate to define a closely spaced reinforcement plate junction;

d) an upper pair of laterally spaced apart right and left side gusset plates and an aligned lower pair of laterally spaced apart lower right and left side gusset plates, wherein the upper pair of gusset plates reside above but proximate to the lower pair of gusset plates with respective upper and lower right side and left side gusset plates being vertically aligned and closely spaced apart to define a gusset plate junction, wherein the upper right side gusset plate is welded to the front primary surface of the first reinforcement plate adjacent the right long side thereof and the upper left side gusset plate is welded to the front primary surface of the first reinforcement plate adjacent the left long side thereof, wherein the lower right side gusset plate is welded to the front primary surface of the second reinforcement plate adjacent the right long side thereof and the lower left side gusset plate is welded to the front primary surface of the second reinforcement plate adjacent the left long side thereof, wherein each respective gusset plate has a perimeter with long sides joined by short sides and opposing primary surfaces with a thickness dimension therebetween, and wherein each gusset plate includes a plurality of longitudinally spaced apart apertures extending through the thickness dimension so that centerlines thereof are substantially orthogonal to the front primary surface of the reinforcement plates, and wherein at least one of the gusset plates has at least one threaded aperture;

e) a right side splice plate having a perimeter with long sides separated by short sides and having opposing front and rear primary surfaces with a plurality of longitudinally spaced apart apertures extending therethrough, the right side splice plate apertures aligned with the right side upper and lower gusset plate apertures;

f) a left side splice plate having a perimeter with long sides separated by short sides and having opposing front and rear primary surfaces with a plurality of longitudinally spaced apart apertures extending therethrough, the left side splice plate apertures aligned with the left side upper and lower gusset plate apertures; and g) a plurality of splice bolts, each splice bolt having a bolt head and an opposing end that extends through a respective right or left side splice plate aperture into an aligned aperture of the upper or lower corresponding right or left side gusset plate so that the splice bolts extend orthogonal to an axially extending centerline of the tower wall bolts extending out from the outer wall into the first and second reinforcement plates, wherein at least one of the splice bolts threadably engages a respective gusset plate threaded aperture with the splice bolt end residing substantially flush with the respective gusset plate.

2. The reinforced tower according to claim 1 wherein at least a majority of the apertures of the upper and lower right and left side gusset plates are threaded, and wherein the corresponding splice bolts threadably engage the right and left side gusset plate threaded apertures and have a length such that respective ends thereof either (i) terminate inside the respective gusset plates or that (ii) are substantially flush therewith to thereby provide a center clearance space between right and left side gusset plates.

3. The reinforced tower according to claim 1 wherein the splice bolts are arranged in a pattern that has substantially regularly spaced apart upper and lower splice bolts that leave an unbolted splice plate region therebetween, the unbolted region extending between the reinforcement plate junction to the gusset plate junction.

4. The reinforced tower according to claim 1 wherein the upper right and left side gusset plates extend a first defined distance beyond the lower short side of the first reinforcement plate, wherein the lower right and left side gusset plates reside a second defined distance below the upper short side of the second reinforcement plate, and wherein the first and second defined distances are a substantially common distance of between about 1-10 inches.

5. The reinforced tower according to claim 1 wherein all of either the upper right or left side gusset plate apertures are threaded and all of the lower right or left side gusset plate apertures are threaded, and wherein the splice bolts threadably engage the gusset plate threaded apertures and have a length such that respective ends thereof either (i) terminate inside the respective gusset plates or that (ii) are substantially flush therewith to thereby provide a center clearance space between right and left side gusset plates.

6. The reinforced tower according to claim 1 wherein all of the apertures of at least one of the right and left side gusset plates are threaded, and wherein the corresponding splice bolts threadably engage the right and left side gusset plate threaded apertures and have a length that either (i) terminates inside the respective gusset plates or that (ii) is substantially flush therewith to thereby provide a center clearance space between right and left side gusset plates.

7. The reinforced tower according to claim 6 wherein the splice bolts threadably attach to the threaded gusset plate apertures so that respective bolt heads abut an outer surface of the right and left splice plates while the ends of the bolts are substantially flush with a respective gusset plate and are devoid of a nut on the bolt end.

8. The reinforced tower according to claim 1 wherein the gusset plate junction is longitudinally offset from the reinforcement plate junction to reside a defined distance above or below the reinforcement plate junction.

9. The reinforced tower according to claim 8 wherein the lower right and left side gusset plates extend a first defined distance beyond the upper short side of the second reinforcement plate, and wherein the upper right and left side gusset plates reside a second defined distance above the lower short side of the second reinforcement plate, and wherein the first and second defined distances are a substantially common distance of between about 1-10 inches.

10. The reinforced tower according to claim 8 wherein the first and second reinforcement plates, the upper and lower pair of gusset plates and the right and left side splice plates define a splice assembly, and wherein the tower has a plurality of splice assemblies at either, or both, circumferentially or longitudinally spaced apart locations of the outer wall.

11. The reinforced tower according to claim 10 wherein the offset of the gusset plate junction and reinforcement junction for the splice assemblies are arranged to vary so that one offset arranges the gusset plate junction above the reinforcement plate junction and another splice assembly arranges the gusset plate junction below the reinforcement plate junction.

12. A reinforced antenna tower comprising:

a) a pole having at least a portion configured as a tubular body with a hollow core, the tubular body having an outer wall with an inner and outer surface;

b) a first reinforcement plate bolted to the outer wall with longitudinally spaced apart tower wall bolts, the first reinforcement plate having a perimeter with right and left long sides and upper and lower short sides, a rear primary surface that contacts the outer surface of the outer wall and an outwardly facing front primary surface;

c) a second reinforcement plate bolted to the outer wall with longitudinally spaced apart tower wall bolts, the second reinforcement plate upper short side residing adjacent a lower short side of the first reinforcement plate to define a closely spaced reinforcement plate junction, the second reinforcement plate having a perimeter with right and left long sides and upper and lower short sides, a rear primary surface that contacts the outer surface of the outer wall and an outwardly facing front primary surface;

d) an upper pair of laterally spaced apart right and left side gusset plates and an aligned lower pair of laterally spaced apart right and left side gusset plates, wherein each respective gusset plate has a perimeter with long sides joined by short sides and opposing primary surfaces separated by a thickness dimension and are oriented so that the primary surfaces are orthogonal to the front primary surfaces of the first and second reinforcement plates, wherein the upper pair of gusset plates reside above but proximate to the lower pair of gusset plates with respective upper and lower right side and left side gusset plates being vertically aligned and closely spaced apart to define a gusset plate junction, and wherein each gusset plate includes a plurality of longitudinally spaced apart threaded apertures extending through the thickness dimension so that a centerline thereof is orthogonal to the front primary surface of the reinforcement plates;

e) a right side splice plate with a plurality of longitudinally spaced apart apertures extending therethrough, the right side long splice plate apertures aligned with corresponding ones of the right side upper and lower gusset plate apertures;

f) a left side splice plate with a plurality of longitudinally spaced apart apertures extending therethrough, the left side splice plate apertures aligned with corresponding ones of the left side upper and lower gusset apertures; and g) a plurality of splice bolts, each splice bolt having a bolt head and an opposing end that extends through a respective right or left side splice plate aperture into an aligned threaded aperture of the corresponding upper or lower left or right side gusset plates so that the splice bolts extend orthogonal to an axially extending centerline of the tower wall bolts extending out from the outer wall into the first and second reinforcement plates with the splice bolt end residing substantially flush with the right side gusset plate to thereby define an open space between the right and left side gusset plates for clearance access to the tower wall bolts extending out from the first and second reinforcement plates.

* * * * *